US010426243B2

(12) United States Patent
Sze

(10) Patent No.: US 10,426,243 B2
(45) Date of Patent: Oct. 1, 2019

(54) HAIR FASTENER

(71) Applicant: Tung Hing Plastic Manufactory Ltd., Kowloon (CN)

(72) Inventor: Ka Chuen Sze, Kowloon (CN)

(73) Assignee: TUNG HING PLASTIC MANUFACTORY LTD., Kowloon (HK)

( * ) Notice: Subject to any disclaimer, the term of this patent is extended or adjusted under 35 U.S.C. 154(b) by 74 days.

(21) Appl. No.: 14/686,911

(22) Filed: Apr. 15, 2015

(65) Prior Publication Data

US 2015/0327649 A1 Nov. 19, 2015

(30) Foreign Application Priority Data

May 14, 2014 (GB) ..... 14080586.4

(51) Int. Cl.
*A45D 8/12* (2006.01)
*A45D 8/00* (2006.01)
(Continued)

(52) U.S. Cl.
CPC ..... *A45D 8/00* (2013.01); *A45D 8/34* (2013.01); *A45D 2007/002* (2013.01)

(58) Field of Classification Search
CPC ... A45D 8/00; A45D 8/34; A45D 8/36; A45D 2007/002; A45D 2008/00;
(Continued)

(56) References Cited

U.S. PATENT DOCUMENTS 2,415,914 A * 2/1947 Silverman ..... A45D 2/20 132/247
2,488,954 A 11/1949 Winters
(Continued)

FOREIGN PATENT DOCUMENTS

GB 2393905 A 4/2004
JP 9121928 A 5/1997

*Primary Examiner* — Rachel R Steitz
(74) *Attorney, Agent, or Firm* — Heslin Rothenberg Farley & Mesiti P.C.; Victor A. Cardona, Esq.; Melvin Li

(57) ABSTRACT

There is provided a hair fastener. The hair fastener has an elongate body made of an elastic material stretchable under tension for maximizing holding capability of hair and a locking means at least part of which made of a stiff material. The locking means includes a first member and a second member arranged at opposite ends of the body. The first member and the second member are releasably engageable with each other by way of a mechanical interference fit in that engagement of the first and second members is achieved independent of degree of tension of the elastic body and engagement or disengagement of the first and second members is achieved by way of one hand operation of a user. The fastener is adapted to assume a first configuration in which the first member and second members are engaged before tying the hair and a second configuration in which the first and second members are disengaged whereby removal of the fastener from the hair in the second configuration minimizes movement of the fastener along the length of the hair and thus eliminating or at least reducing frictional contact with the hair. With this construction, majority part of the hair fastener can be made of a high friction material to provide improved gripping or holding security of hair and yet hair is not damage during removal of the fastener from user's hair.

16 Claims, 10 Drawing Sheets

(51) Int. Cl.
*A45D 8/34* (2006.01)
*A45D 7/00* (2006.01)

(58) Field of Classification Search
CPC ..... A45D 2008/002; A45D 2008/004; A45D 2008/34; Y10T 24/1402; Y10T 24/1404; Y10T 24/141; Y10T 24/1498; Y10T 24/15; Y10T 24/153; Y10T 24/31
See application file for complete search history.

(56) References Cited

U.S. PATENT DOCUMENTS 2,805,673 A * 9/1957 Solomon ..... A45D 8/34 132/275
4,922,986 A * 5/1990 Leibowitz ..... E06B 9/367 160/173 V
5,409,330 A * 4/1995 Naines ..... F16G 11/00 24/116 A
5,913,319 A 6/1999 Tsai
7,337,786 B2 * 3/2008 Sonstegard ..... A45D 8/12 132/273
7,575,388 B2 * 8/2009 Shimada ..... B42B 5/08 24/460
8,850,675 B2 * 10/2014 Frydlewski ..... A43B 3/0078 24/300
2004/0149305 A1 8/2004 Tsai
2009/0178690 A1 * 7/2009 Olson ..... A45D 8/36 132/275
2013/0042885 A1 * 2/2013 Pilan ..... A45D 8/34 132/273
2013/0199020 A1 * 8/2013 Frydlewski ..... A43B 3/0078 29/525.01
2014/0283869 A1 * 9/2014 Sonstegard ..... A45D 8/34 132/275
2015/0230579 A1 * 8/2015 Getz ..... A45D 8/34 132/200

* cited by examiner

HAIR FASTENER

CROSS REFERENCE TO RELATED APPLICATION

The present application claims priority from United Kingdom Patent Application No. GB1408586.4 filed on May 14, 2014, the contents of which are incorporated herein in its entirety.

FIELD OF THE INVENTION

The present invention is concerned with a hair fastening means, and a method of making same.

BACKGROUND OF THE INVENTION

There is a variety of hair fastening means including hair clips, barrettes, and headbands for hair management. While all these devices are effective in different ways in hair management, many users still prefer to use traditional stationery-type rubber bands to manage and tie their hair. This is because these rubber bands are compact in size and are not prominent in appearance and can tidy hair simply, tightly and reliably, and yet their cost is low. One disadvantage of using such rubber bands for hair management is however that once a lock of hair is tied up, removing the rubber bands can often be very difficult because they tend to tangle with the hair. Often when removing the rubber bands from the hair, considerable force would be required, thus causing hair be pulled with excessive force and damage or even breakage of hair.

In view of the disadvantages of traditional stationery-type rubber bands for hair management, improved rubber bands for hair fastening have been proposed. The improved rubber bands are different in that they are made of a relatively thin sheet material forming the band. Further, the material that makes up the bands and the hair have a lower frictional relationship. As such, they can be removed from tied hair relatively easily. From the perspective of reducing hair damage, these improved bands are advantageous. However, the drawback is that they are less effective in holding and tying hair in place.

The present invention seeks to provide an improved hair fastening band, or least to provide an alternative to the public.

SUMMARY OF THE INVENTION

According to a first aspect of the present invention, there is provided a hair fastener comprising an elongate body made of an elastic material stretchable under tension and a locking means including a first member and a second member arranged at opposite ends of the body, the first and second members made of a material stiffer than the elastic material, wherein the first member and said second member are releasably engageable with each other by way of a mechanical interference fit in that engagement of the first and second members is achieved independent of degree of tension of the elastic body, and disengagement of the first and second members is achieved by way of one hand operation of a user. The fastener may be adapted to assume a first configuration in which the first member and second members are engaged before tying the hair, or a second configuration in which the first and second members are disengaged whereby removal of the fastener from the hair in the second configuration minimizes movement of said fastener along the length of the hair and thus eliminating or at least reducing frictional contact with the hair. The first member and the second member may be connected to the respective opposite ends of the elongate body by overmoulding the elastic material over the first member and the second member thus integrally forming the opposite ends. With this construction, majority part of the hair fastener can be made of a high friction material to provide improved gripping or holding security of hair and yet hair is not damaged during removal of the fastener from user's hair.

In a first embodiment, the first member may generally be in the form of a disc body with a through-opening in substantially a center thereof, and the second member may be provided with a base body and a post extending from the base body, and the post may have an enlarged flange at a distal end thereof such that the flange and the post of the second member together forming a hook means, and wherein the fastener may be adapted to assume the first configuration in which the first and second members are secured with each other with the hook means locking against the first member at the opening thereof.

Preferably, length of the post and thickness of the first member may be comparable such that the enlarged flange of the post can pass through the opening for locking against inner rim of the opening of the first member. The length of the post may be slightly longer than the thickness of the first member such that locking of the second member against the first member at the post produces a mechanical interference fit. The first member may generally be in the form of a ring.

The first and second members may share comparable circumferential profile such that in the first configuration when the first member and the second member are locked against each other the first member and the second member circumferentially align with each other.

The surrounding structure of the first member defining the opening may be provided with a recess, the recess is adapted to receive the post when the first member engages with the second member in the first configuration.

In the first configuration, the post received in the recess may be adapted to be moved away from the recess by fingers of one hand of a user such that the flange be dislodged from the surrounding structure and the post be retreated away from the opening, whereby the first and second member may be disengagable from each other thus assuming the second configuration.

The first member and said second member may be configured to resemble a buttonhole-button structure.

In a second embodiment, the first member may include surrounding structure defining at least an opening and the second member may include a base portion from which a post with an enlarged flange extends.

The surrounding structure of the first member may be slightly flexible such that when outwardly flexed, size of the opening may be enlarged or at least shape of the opening is changed.

When the first and second members are engaged with each other, at least part of the surrounding structure may surround the post for interference therewith.

The opening of the first member may resemble two adjoining circles. One of the circles may resemble close to a full circle. The close-to-a-full-circle of the part the opening may be arranged at a proximal end of the fastener. When the first and second members are engaged with each other, part of the surrounding structure defining one of the two adjoining circles of the opening and the post may form the mechanical interference fit.

The hair fastener may be adapted to release the post from the first member with fingers of one hand of a user by moving opposite portions of the surrounding structure apart.

In an embodiment, the elastic material may be selected from the group consisting of TPE, TPU, PU, silicone, and natural rubber. The stiff material may be selected from the group consisting of ABS, PP, PE, nylon, PC, AS, POM, GPPS, HIPS and Acrylic.

According to a second aspect of the present invention, there is provided a method of tying hair by using a hair fastener as described above, comprising a step of connecting the first and second members by the locking means, and placing the hair fastener around hair to be tied.

BRIEF DESCRIPTION OF THE DRAWINGS

Some embodiments of the present invention will now be explained, with reference to the accompanied drawings, in which.

DETAILED DESCRIPTION OF THE INVENTION

The present invention is concerned with a hair fastener.

FIGS. 1-8 illustrate a first embodiment of a hair fastener, generally designated 2, according to the present invention.

Figure 1:
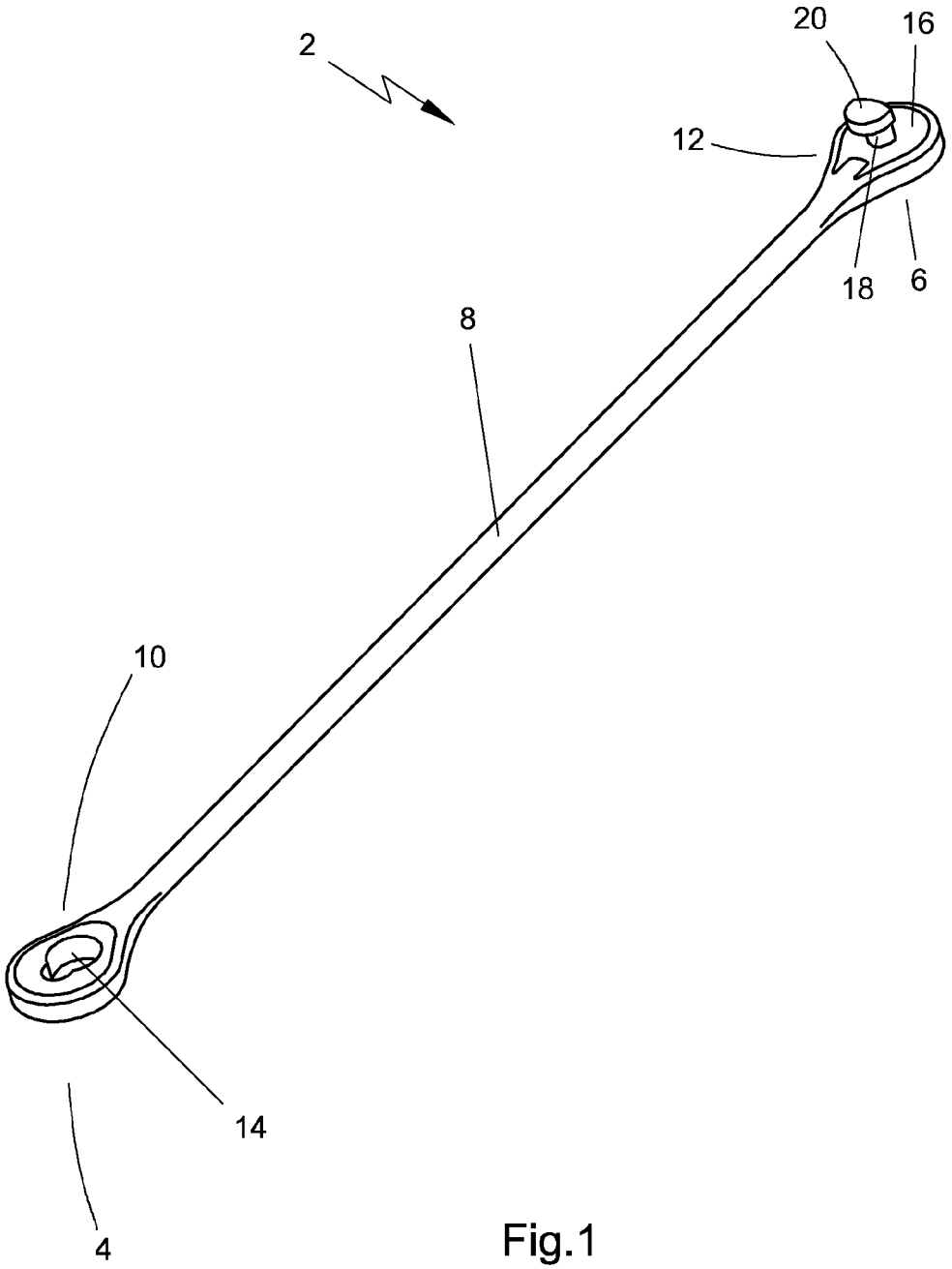
FIG. 1 is a perspective view of an embodiment of a hair fastener in accordance with an embodiment of the present invention.
Figure 4:
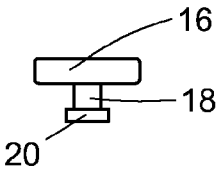
FIG. 4 is an opposite end view of the hair fastener of FIG. 2.
Figure 2:
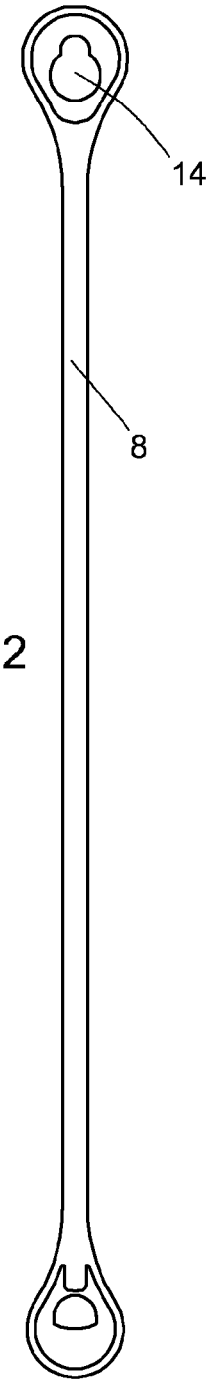
FIG. 2 is a plan view of the hair fastener of FIG. 1.
Figure 5:
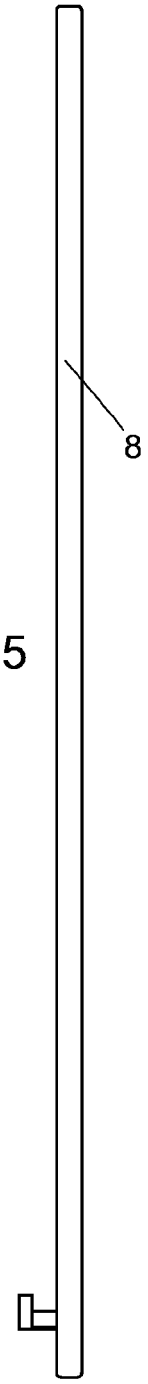
FIG. 5 is a side view of the hair fastener of FIG. 1.
Figure 6:
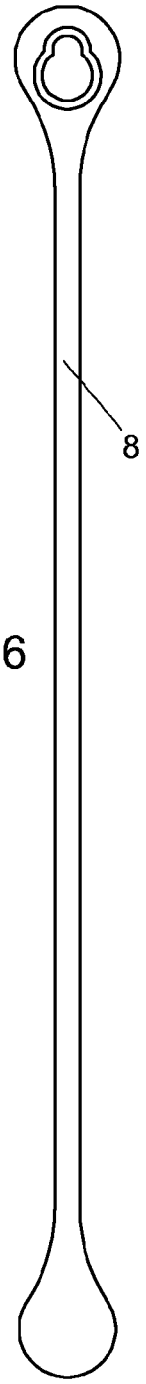
FIG. 6 is an opposite plan view of the hair fastener of FIG. 1.
Figure 3:
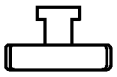
FIG. 3 is an end view of the hair fastener of FIG. 2.

FIG. 1 shows that the hair fastener 2 is in an open configuration in which opposite ends 4, 6 of the fastener 2 are not connected together. The fastener 2 generally has an elongate body 8. The elongate body 8 is made of an elastic material. The fastener 2 is provided with a locking means made of a stiff material. The locking means includes a first member 10 arranged at one end of the body 8 and a second member 12 arranged at the opposite end of the body 8. The first member 10 generally takes the form of a disc body with a through-opening 14 in substantially the center thereof, and the second member 12 is provided with a base body 16 and a post 18 extending from the base 16. The post 18 has an enlarged flange 20 at a distal end thereof such that the flange 20 and the post 18 of the second member 20 forming a hook means.

In the open configuration, the opposite ends 10, 12 of the fastener 2 are not connected with each other. In this configuration, the elongate body 8 is not under tension.

FIGS. 2, 3, 4, 5 and 6 are top plan view, end view, opposite end view, side view and opposite side view, respectively, showing the fastener 2.

Figure 7:
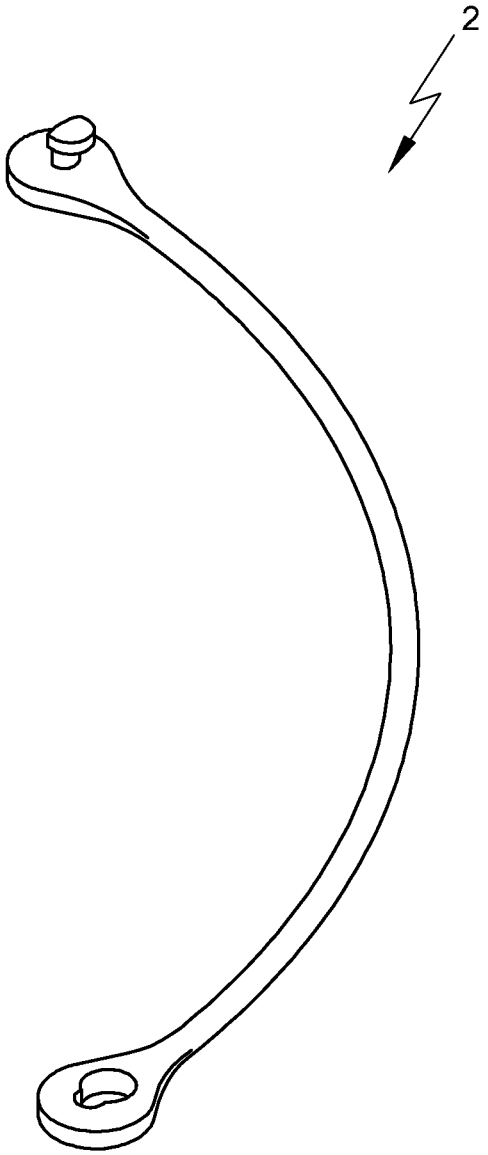
FIG. 7 is a perspective view of a the hair fastener of FIG. 1, but in a disengaged or open configuration.

FIG. 7 is a perspective view of the fastener 2. As shown in this figure, the fastener 2 is disposed in a slightly different configuration in which the elongate body is somewhat flexed. This is due to the elastic nature of the material making the elongate. The preferred material of the elongate body is selected from a group including TPE, TPU, PU, silicone, and natural rubber.

Figure 8:
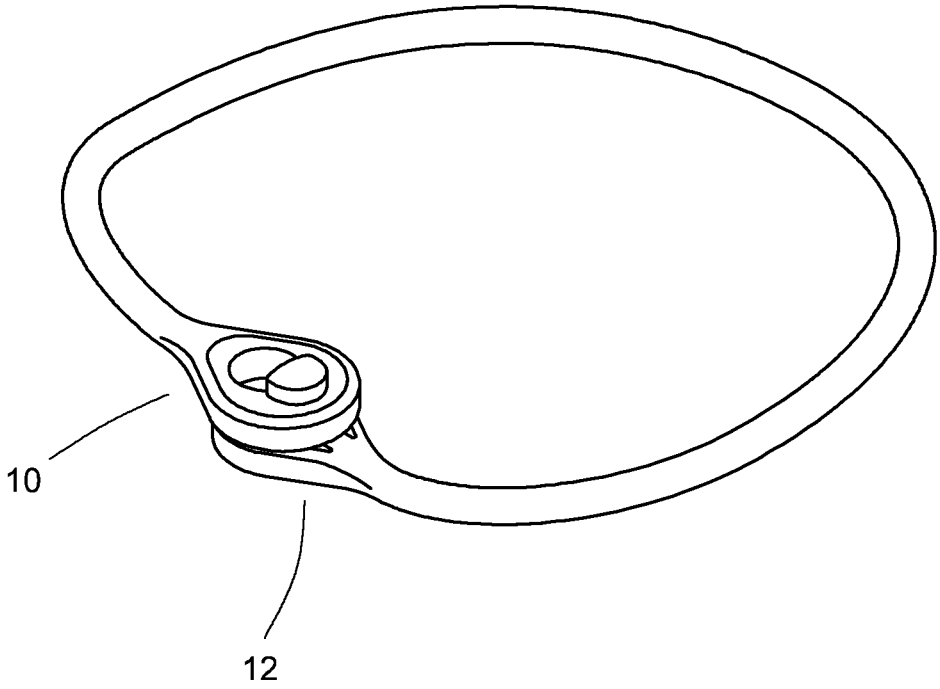
FIG. 8 is a perspective view of a the hair fastener of FIG. 1, but in a looped or closed configuration.

FIG. 8 is a different perspective view of the fastener 2. As shown in this figure, the fastener 2 is disposed in a different configuration in which the opposite ends, or the first and second members 10, 12 of the locking means, are connected together. In this configuration, the fastener 2 adopts a looped or closed profile. It is envisaged that the fastener 2 in this looped configuration can be used to tie around a lock of hair. It is however to be noted that in the absence hair tied around by the fastener 2 in this looped configuration, the first and second members 10, 12 do not lock against each other as tightly as they otherwise would. However, still they are locked against each other due to a sufficient mechanical interference fit.

Figure 9:
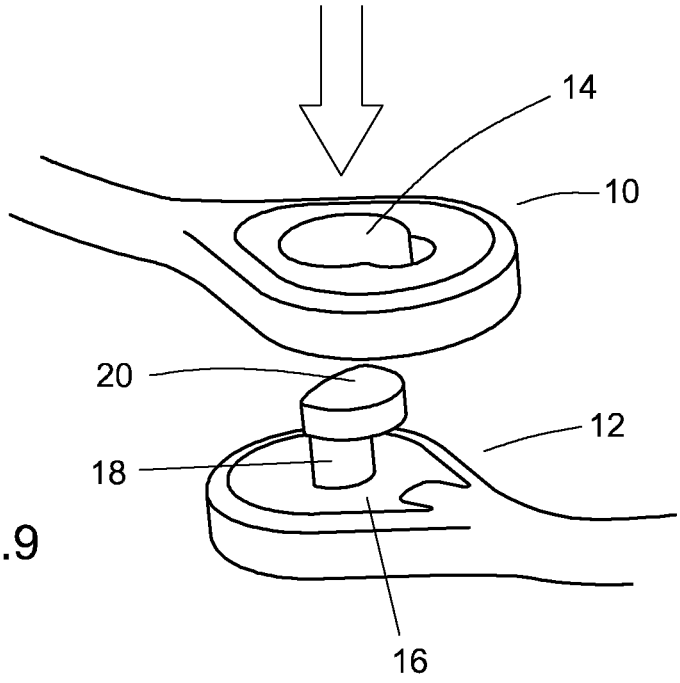
FIGS. 9-11 are a series of three successive schematic diagrams showing stages during connection of opposite ends of the hair fastener of FIG. 1, thus forming a looped or closed configuration.
Figure 10:
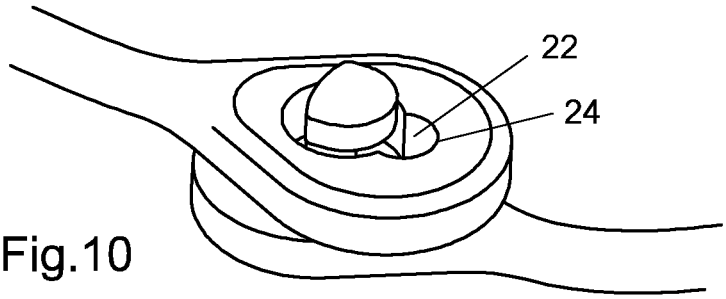
Figure 11:
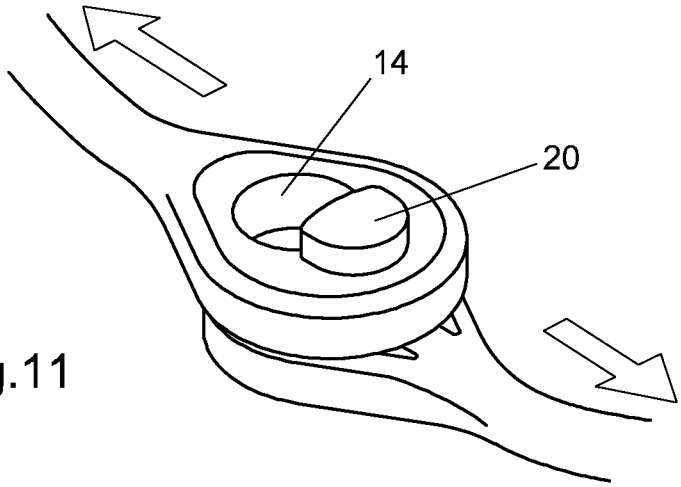

FIGS. 9-11 further illustrate the construction of the locking means and its working. In this embodiment, the stiff material of the locking means is selected from a group including ABS, PP, PE, Nylon, PC, AS, POM, GPPS, HIPS and acrylic. It is the use of a combination of these specific materials for the elongate body and the locking means which contributes to the effectiveness of the hair fastener.

FIG. 9 shows that the disc-like first member 10 of the locking means is generally in the form of a ring with a relatively thin and circumferential body having the through-opening 14 which is nearly circular in shape. However, surrounding structure of the body defining the nearly circular shaped opening 14 has a cut-out region 22 at its distal end of the first member body 10, the cut-out region 22 forming a recess. Please also see FIG. 10.

FIG. 9 also shows that the second member 12 is in the form of a disc forming the base 16. In this embodiment, the thickness of the second member 12 and the thickness of the first member 10 are substantially the same. The post 18 extended from the base 16 of the second member 12 is provided with the flange 20 which extends away from the distal end of the second member 12 and towards the elongate body 8. Thus, the post 18 has a narrower middle region, ended with an enlarged region of the flange 20. Although the post 18 is ended with an enlarged flange 20, the width of the enlarged region is still smaller than the diameter of opening 14 such that it can pass through the opening 14.

FIG. 10 illustrates that the first member 10 and the second member 12 are being secured with each other. This is achieved by firstly positioning and inserting the post 18 of the second member 12 through the opening 14 of the first member 10. The post 18 of the second member 12 is just long enough such that as explained above the flange 20 can pass through the opening 14.

Since the length of the post 18 and the thickness of the first member 10 are comparable, the enlarged flange 20 of the post 18 can at least just pass through the opening 14 for locking against inner rim 24 of the opening 14 of the first member 10. Specifically, the length of the post 18 is just long enough such that locking of the second member 12 against the first member 10 at the post 18 produces a vertical interference fit.

FIG. 11 illustrates that in use, when hair is tied around by the fastener 2 in the looped configuration, a tension, as indicated by the arrows, is created and as such the post 18 with the enlarged flange 20 forming the hook means further engages against the recessed region of the first member 10, thus forming a tight lock. Hair is thus securely tied thereby. Due to the presence of the flange 20 which forms a hook with the post 18, the second member 12 would not disengage from the first member 10 by itself. It is envisaged that when the first member 10 and the second member 12 are engaged with each other, lower surface of the flange 20 of the second member 12 abuts with outwardly facing surface of the first member 10.

Figure 12:
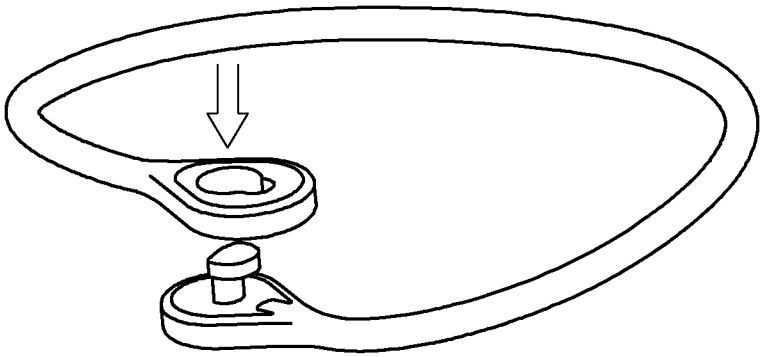
FIGS. 12-14 similarly are a series of three successive schematic diagrams showing stages during connection of opposite ends of the hair fastener of FIG. 1, thus forming a looped or closed configuration, the diagrams showing the entire hair fastener.
Figure 13:
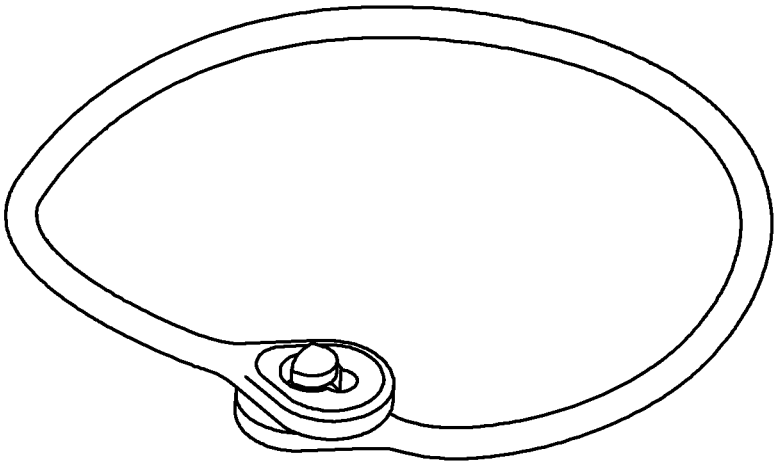
Figure 14:
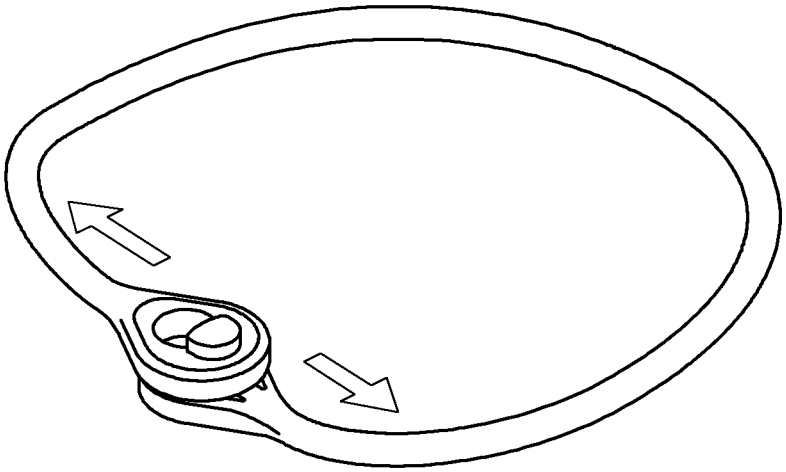

FIGS. 12-14 are schematic diagrams similar to FIGS. 9-11 although FIGS. 12-14 show the full view of the fastener 2.

As shown in FIGS. 12-14, the first and second members 10, 12 share comparable circumferential profile such that in the looped or closed configuration when the first member 10 and the second member 12 are stacked on top of each other they circumferentially align with each other with their circumferential surrounding fully flushed, thus minimizing any undesirable tangling with hair of user in use.

It is also to be noted that the recessed region 24 of the surrounding structure of the first member 10 is adapted to tightly receive the post. This also facilitates engagement of the post 18 with the first member 12.

Figure 15:
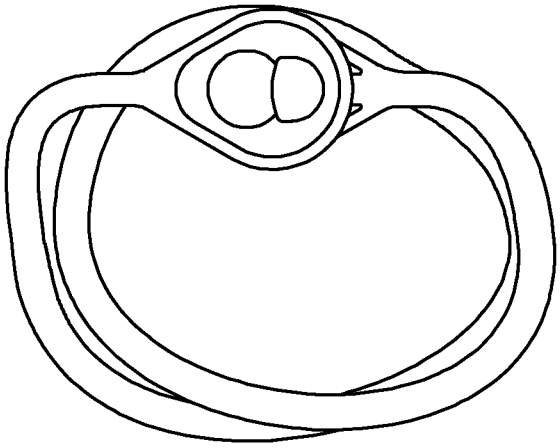
FIG. 15 illustrates the hair fastener of FIG. 8, but in a coiled or double coiled configuration.
Figure 16:
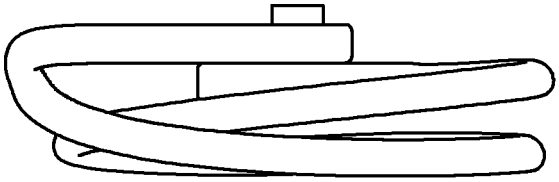
FIG. 16 is a side view of the hair fastener of FIG. 15.
Figure 17:
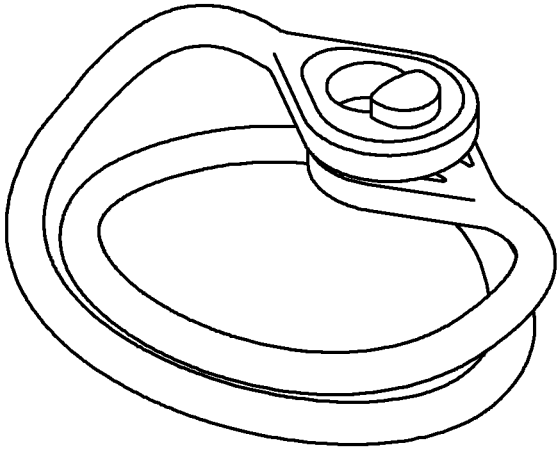
FIG. 17 is a perspective view of the hair fastener of FIG. 15.
Figure 18B:
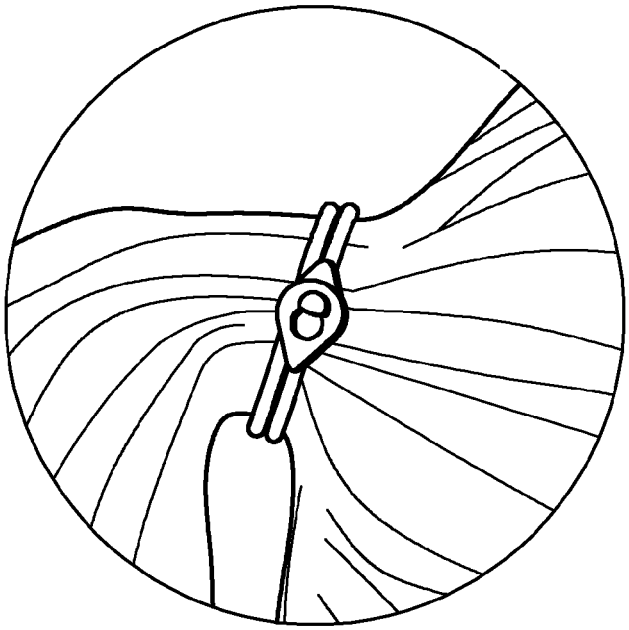
FIG. 18*b* is an enlarged view of the hair fastener of FIG. 18*a;*
Figure 18A:
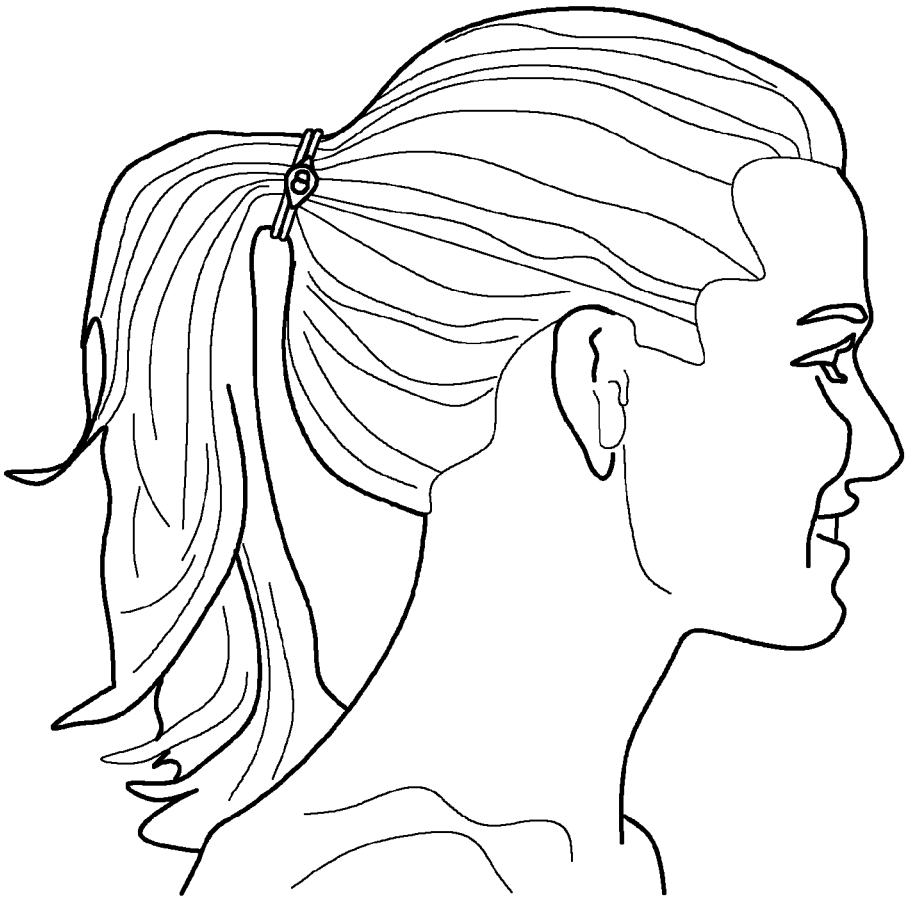
FIG. 18*a* is a schematic illustration showing a user wearing a hair fastener of FIG. 1.
Figure 19B:
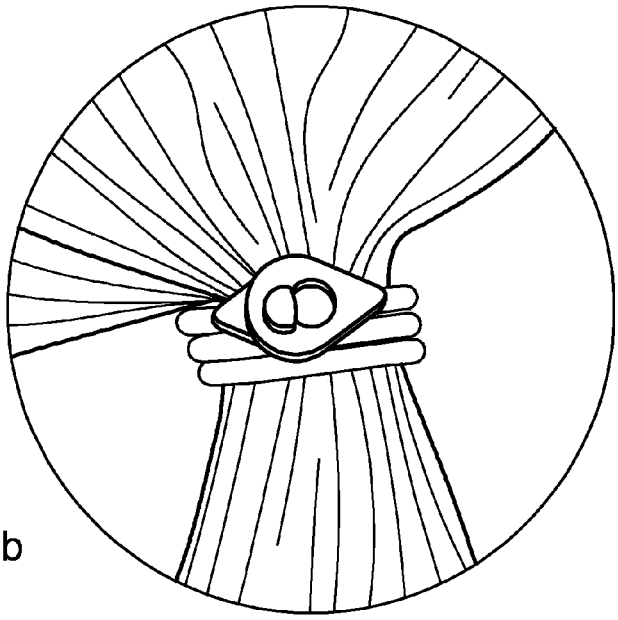
FIG. 19*b* is an enlarged view of the hair fastener of FIG. 19*a*.
Figure 19A:
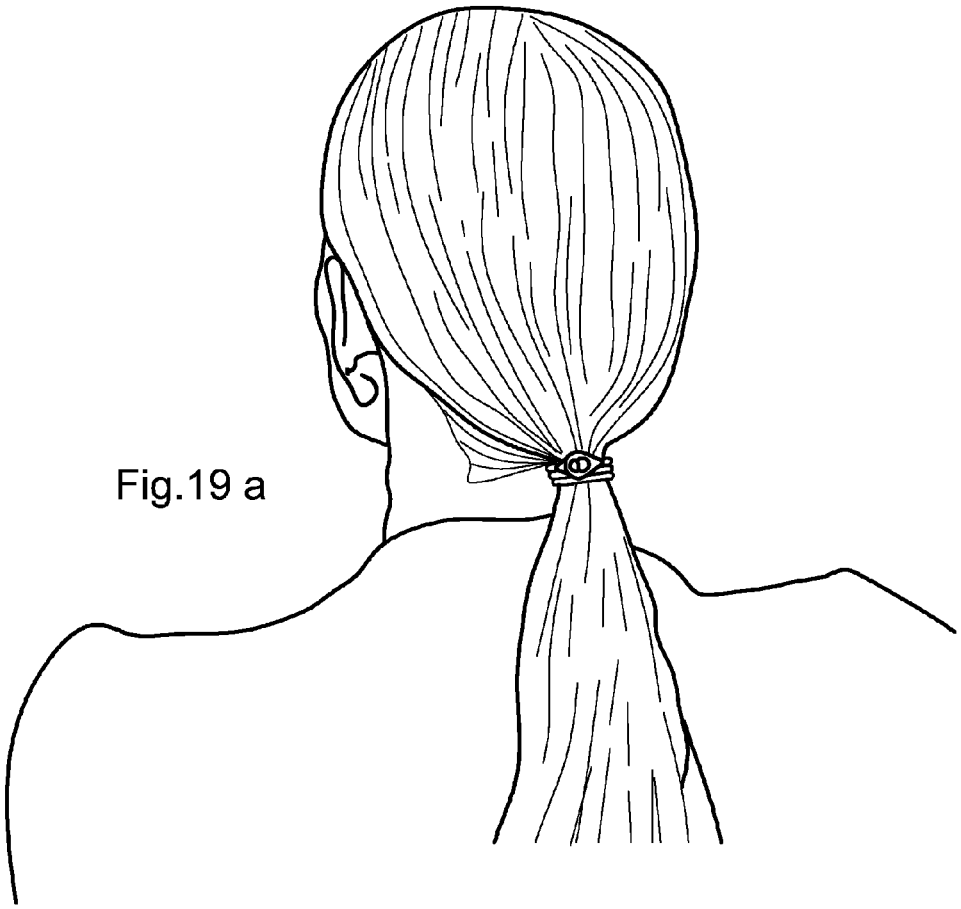
FIG. 19*a* is another schematic illustration showing view of a user wearing a hair fastener of FIG. 1.

FIG. 15 shows the fastener 2 in a different configuration in which the fastener 2 is closed and double coiled. When used for tying narrower lock of hair, the fastener 2 may be in this double-coiled configuration. FIGS. 18*a-b* illustrate the fastener 2 when worn by a user in this double-coiled configuration. FIGS. 19*a-b* are similar to FIGS. 18*a-b* although the fastener 2 is closed and triple coiled, and worn by a user.

When removing the fastener 2 from tied hair, a user merely needs to push the protruded flange 20 laterally away from the recessed region 24 of the first member 10 of the locking means, such that the flange 20 exits via the opening of the first member 10. Once this small movement is achieved, the fastener loses its tension and the opposite ends 4, 6 of the fastener 2 disengage from each other, and can be removed easily. It is to be noted that during disengagement, there is no pulling of the fastener 2 along the length of hair of the user, and as such there is no issue of damage or breakage of hair.

Figure 20A:
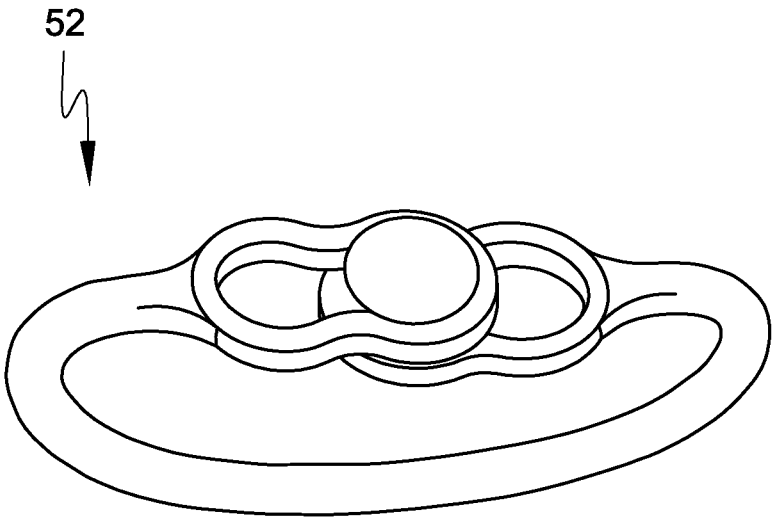
FIG. 20*a* and FIG. 20*b* are schematic views showing two configurations of another embodiment of a hair fastener according the present invention.
Figure 20B:
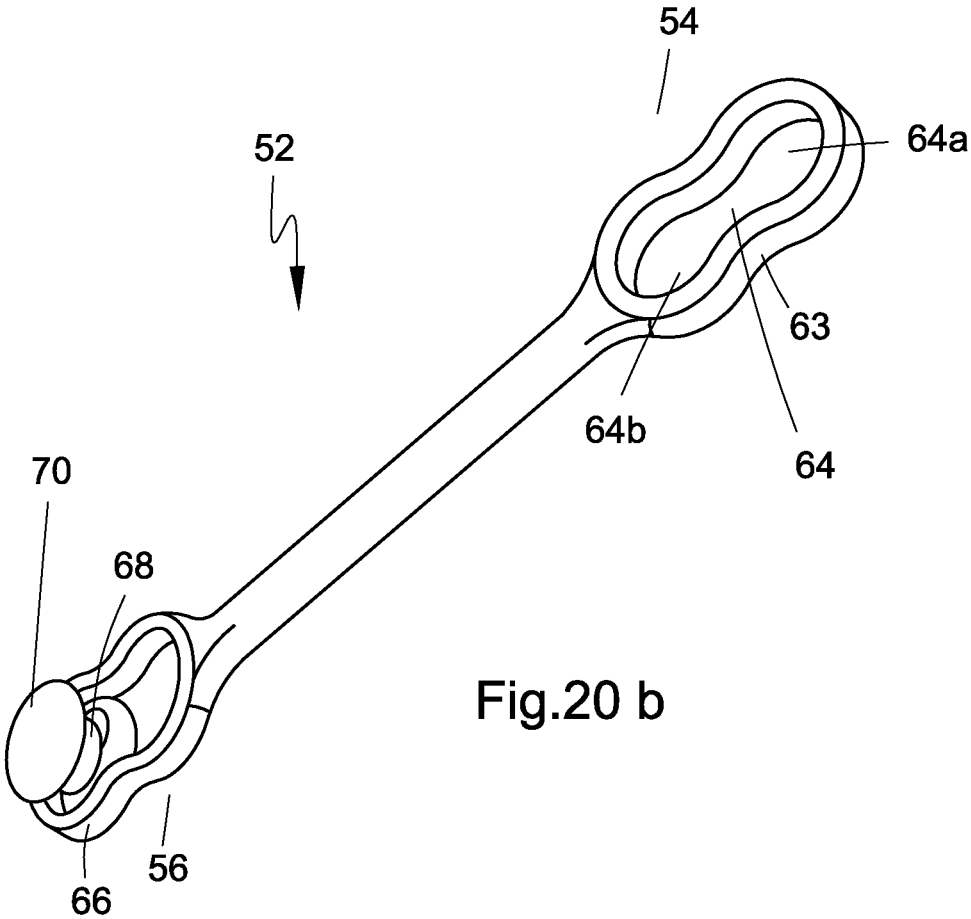

FIGS. 20*a*-20*b* illustrate a second embodiment of a hair fastener 52 according to the present invention. FIG. 20*a* illustrates the hair fastener 52 in an open configuration while the FIG. 20*b* illustrate the hair fastener 52 in a closed configuration. While the second embodiment is similar to the first embodiment 2, there are a number of differences.

The fastener 52 likewise has a first member 54 and a second member 56. The first member 54 is provided with a thorough opening 64 defined by surrounding structure 63 of the first member 54. The opening 64 is in the form of two adjoining circles 64*a*, 64*b*. The second member 56 has a base portion 66 from which a post 68 with an enlarged flange 70 extends. The surrounding structure 63 of first member 54 is somewhat flexible such that it can outwardly flex, thus slightly enlarging the size of the opening 64 or at least change the shape of the opening 64. Once the opening 64 is enlarged it can allow the post 68 to enter for the surrounding structure 63 (or at least a part thereof) to fit around the post 68 for locking purpose. The surrounding structure 63 is configured such that only the part of the surrounding structure 63 defining the part of the opening of one of the two adjoining circles engages with the post when the first and second members are locked against each other. In an alternative embodiment, the post 68 and/or the flange 70 are configured to be engageable with the first member 54 regardless if whether the surrounding structure 63 is flexible. For example, the post 68 and/or the flange 70 are slightly resilient for the flange 70 to pass the opening 64*a* for locking purpose.

The fasteners 2, 52 can be made in a number of ways. One preferred mode of manufacturing is to first provide the first member and the second member made of the rigid material. Then the elongate body of the fastener is formed by molding using one of the elastic materials over the first and second members. Before molding, the first and second members are however to be positioned such that the opening of the first member faces a direction and the post with the enlarged flange extends to the same direction. Once molded, the fastener forms an integral structure with dual material. Advantageously, the ends of the elongate members are formed without using any glue or clamping means.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. An elongate hair fastener comprising a first member, a second member which together with the first member forms a locking means, and a third elongate member connecting the first member and the second member in that the first member and the second member are arranged at opposite ends of the third member, wherein the first member and the second member are made of a material stiffer than a material of the third member, and the material of the third member is elastic and stretchable under tension for maximizing holding capability of hair in use, wherein:

said fastener is adapted to assume a first configuration in which the said first member and said second member are engaged before tying the hair wherein said first member and said second member are circumferentially aligned with each other, or a second configuration in which said first and second members are disengaged whereby removal of said fastener from the hair minimizes movement of said fastener along the length of the hair and thus eliminating or at least reducing frictional contact with the hair;

said first member and said second member are connected to the respective opposite ends of said third elongate member by overmoulding said elastic material over said first member and said second member thus integrally forming the opposite ends;

a surrounding structure of said first member defining an opening and a recess in communication with said opening, the recess smaller than the opening and adapted to receive a post extending from said second member when said first member engages and secures with said second member in the first configuration;

the opening and the recess comprising circle portions of two adjoining circles directly connected to each other such that arcs of the circle portions intersect with each other at opposite intersecting points such that intersecting portions of said circle portions curve from said intersecting points radially outwardly and form a ridge between said opening and said recess, said intersecting points are located further radially inwardly than a remainder of the surrounding structure defining the opening and the recess;

in the first configuration the post is fitted in the recess with said first member and said second member circumferentially aligned;

said first member and said second member are releasably engageable with each other by way of a mechanical interference fit in that, due to profiles of the two adjoining circles, the intersecting arcs and material characteristics of the surrounding structure, the engagement and securement of said first and second members is achieved independent of degree of tension of said elastic body, and disengagement of said first and second members is achieved by way of one hand operation of a user;

the opening comprising close to a full circle; and the opening arranged closer to the third member of said fastener than the other circle(s).

2. A hair fastener as claimed in claim 1, wherein length of said post and thickness of said first member are comparable such that said enlarged flange of said post can pass through the opening for locking against inner rim of the opening of said first member.

3. A hair fastener as claimed in claim 2, wherein the length of said post is slightly longer than the thickness of said first member such that locking of said second member against said first member at the post produces a mechanical interference fit.

4. A hair fastener as claimed in claim 3, wherein said first and second members share comparable circumferential profile such that in the first configuration when said first member and said second member are locked against each other said first member and said second member circumferentially align with each other.

5. A hair fastener as claimed in claim 4, wherein in the first configuration said post received in the recess is adapted to be pushed away from the recess by fingers of one hand of a user such that said flange be dislodged from said surrounding structure and said post be retreated away from the opening, whereby said first and second member are disengagable from each other thus assuming the second configuration.

6. A hair fastener as claimed in claim 1, wherein said first member and said second member are configured to resemble a buttonhole-button structure.

7. A hair fastener as claimed in claim 1, wherein said first member includes surrounding structure defining at least an opening and said second member includes a base portion from which a post with an enlarged flange extends.

8. A hair fastener as claimed in claim 7, wherein said surrounding structure of said first member is slightly flexible such that when outwardly flexed, size of the opening is enlarged or at least shape of the opening is changed.

9. A hair fastener as claimed in claim 1, wherein when said first and second members are engaged with each other, part of said surrounding structure defining one of the two adjoining circles of the opening and said post form the mechanical interference fit.

10. A hair fastener as claimed in claim 1, wherein the stiff material is selected from the group consisting of ABS, PP, PE, nylon, PC, AS, POM, GPPS, HIPS and Acrylic.

11. A method of tying hair using a hair fastener as claimed in claim 1, comprising a step of connecting said first and second members by said locking means, and placing said hair fastener around hair to be tied.

12. A hair fastener as claimed in claim 1, wherein the intersecting points are located between centers of the two adjoining circles.

13. A hair fastener as claimed in claim 1, wherein the intersecting points are located opposite each other about an axis connecting centers of the two adjoining circles such that the intersecting points are located closer to the axis than is the remainder of the surrounding structure relative to the axis.

14. A hair fastener as claimed in claim 12, wherein the intersecting portions curve from said intersecting points radially outwardly away from an axis connecting centers of the two adjoining circles.

15. An elongate hair fastener comprising a first member, a second member which together with the first member forms a locking means, and a third elongate member connecting the first member and the second member in that the first member and the second member are arranged at opposite ends of the third member, wherein the first member and the second member are made of a material stiffer than a material of the third member, and the material of the third member is elastic and stretchable under tension for maximizing holding capability of hair in use, and member wherein:

said fastener is adapted to assume a first configuration in which the said first member and second members are engaged and circumferentially aligned before tying the hair, or a second configuration in which said first and second members are disengaged whereby removal of said fastener from the hair minimizes movement of said fastener along the length of the hair and thus eliminating or at least reducing frictional contact with the hair;

said first member and said second member are connected to the respective opposite ends of said third elongate member by overmoulding said elastic material over said first member and said second member thus integrally forming the opposite ends;

surrounding structure of said first member being flexible and defining an opening and a recess, the recess is smaller than the opening and adapted to receive a post extending from said second member when said first member engages and secures with said second member in the first configuration;

the opening and the recess comprising circle portions of two directly connected adjoining circles such that arcs of the circle portions intersect with each other at opposite intersecting points such that intersecting portions of the circle portions curve from the intersecting points radially outwardly and form a ridge between said opening and said recess, the intersecting points located further radially inwardly than a remainder of the surrounding structure defining the opening and the recess;

the opening comprising close to a full circle;

the opening is arranged at a proximal end of said fastener.

16. An elongate hair fastener comprising:

a first member, a second member which together with the first member forms a locking means, and a third elongate member connecting the first member and the second member in that the first member and the second member are arranged at opposite ends of the third member, wherein the first member and the second member are made of a material stiffer than a material of the third member, and the material of the third member is elastic and stretchable under tension for maximizing holding capability of hair in use, wherein:

said fastener is adapted to assume a first configuration in which the said first member and said second member are engaged before tying the hair wherein said first member and said second member are circumferentially aligned with each other, or a second configuration in which said first and second members are disengaged whereby removal of said fastener from the hair minimizes movement of said fastener along the length of the hair and thus eliminating or at least reducing frictional contact with the hair;

said first member and said second member are connected to the respective opposite ends of said third elongate member;

a surrounding structure of said first member defining an opening and a recess in communication with said opening, the recess smaller than the opening and adapted to receive a post extending from a base of said second member when said first member engages and secures with said second member in the first configuration;

said second member comprising an enlarged flange at a distal end of said post, said flange having a semicircular portion extending from said post in a direction toward said third member and away from a distal free end of said second member;

said post, said flange and said base bounding a space for receiving said first member and forming a hook, and wherein said first member is received in said space such that said post is received in said recess and said flange contacts said first member to cause said hook to lock against said first member to form a mechanical interference fit;

said flange having a flatter side opposite said semicircular portion, said flatter side comprising an aligned portion aligned with said post on an opposite side of said post relative to said space;

said post having a semicircular shape on a side thereof closer to said third member, said post configured to engage the recess to form the mechanical interference fit.

* * * * *